US007828280B2

(12) United States Patent
Kim et al.

(10) Patent No.: US 7,828,280 B2
(45) Date of Patent: Nov. 9, 2010

(54) PAPER FEEDING APPARATUS AND IMAGE FORMING APPARATUS HAVING THE SAME

(75) Inventors: Jong-woo Kim, Younin-si (KR); Hyun-ki Cho, Hanam-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 512 days.

(21) Appl. No.: 11/698,096

(22) Filed: Jan. 26, 2007

(65) Prior Publication Data

US 2008/0054548 A1 Mar. 6, 2008

(30) Foreign Application Priority Data

Aug. 31, 2006 (KR) ..... 10-2006-0083499

(51) Int. Cl.
*B65H 3/16* (2006.01)

(52) U.S. Cl. ..... 271/18.1

(58) Field of Classification Search ..... 271/18.1
See application file for complete search history.

(56) References Cited

U.S. PATENT DOCUMENTS

| | | | | |
|---|---|---|---|---|
| 1,716,602 | A * | 6/1929 | Ross | 271/18.1 |
| 1,870,336 | A * | 8/1932 | Lincoln | 271/18.2 |
| 1,870,339 | A * | 8/1932 | Lincoln | 271/18.2 |
| 2,999,687 | A * | 9/1961 | Hommel | 271/18.1 |
| 3,224,757 | A * | 12/1965 | Parke et al. | 271/10.01 |
| 3,353,822 | A * | 11/1967 | Dangelmaier et al. | 271/18.1 |
| 3,595,563 | A | 7/1971 | Rostoker et al. | |
| 3,647,045 | A * | 3/1972 | Wegener | 271/193 |
| 5,402,304 | A * | 3/1995 | Smith | 271/105 |

FOREIGN PATENT DOCUMENTS

| | | |
|---|---|---|
| DE | 2062 108 | 10/1972 |
| DE | 25 00 222 | 3/1976 |
| EP | 0 060 774 | 9/1982 |
| FR | 2 461 668 | 2/1981 |
| JP | 61 086334 | 5/1986 |
| JP | 05-139548 | 6/1993 |
| JP | 2001-233505 | 8/2001 |

(Continued)

OTHER PUBLICATIONS

"Media Separation With Electrostatic Force" IBM Technical Disclosure Bulletin, IBM Corp. New York, US, vol. 37, No. 5, May 1, 1994, p. 505, XP000453240.

(Continued)

*Primary Examiner*—Gene Crawford
*Assistant Examiner*—Gerald W McClain
(74) *Attorney, Agent, or Firm*—Staas & Halsey LLP

(57) ABSTRACT

A paper feeding apparatus capable of preventing noises generated when picking up and transferring paper, and an image forming apparatus having the same. The paper feeding apparatus according to the present invention comprises a pickup unit, which is disposed upstream of a paper cassette relative to the direction in which the uppermost sheet of paper loaded in the paper cassette moves, to pick up the uppermost sheet of paper, and a lifting unit which lifts the sheet of paper vertically to reduce friction between the paper and the paper beneath it when the pickup unit picks up the sheets of paper.

13 Claims, 8 Drawing Sheets

FOREIGN PATENT DOCUMENTS

| | | | | |
|---|---|---|---|---|
| JP | 2004-352381 | | | 12/2004 |
| JP | 2004352381 | A | * | 12/2004 |
| JP | 2005-119756 | | | 5/2005 |
| JP | 2005119756 | A | * | 5/2005 |

OTHER PUBLICATIONS

Partial Search Report issued Dec. 18, 2008 and Extended European Search Report issued Mar. 10, 2009 issued from European Patent Office with respect to European Patent Application No. 07108987.4 filed on May 25, 2007.

* cited by examiner

PAPER FEEDING APPARATUS AND IMAGE FORMING APPARATUS HAVING THE SAME

CROSS-REFERENCE TO RELATED APPLICATIONS

This application claims all benefits accruing under 35 U.S.C. §119 from Korean Patent Application No. 2006-83499, filed on Aug. 31, 2006 in the Korean Intellectual Property Office, the entire disclosure of which is incorporated herein by reference.

BACKGROUND OF THE INVENTION

1. Field of the Invention

Aspects of the present invention relate to a paper feeding apparatus of an image forming apparatus, and more particularly, to a paper feeding apparatus for reducing noise generated during paper feeding, and an image forming apparatus having the same.

2. Related Art

Noise generated by office machines used in offices or homes can result in reduced operating effectiveness. Noise is often generated when paper is picked up and fed into an image forming apparatus, such as a printer, a photocopier, a facsimile machine, or a multifunctional product. The noise may come from various sources, such as friction between mechanical components and the printable media or the steep slope of the transfer path. Accordingly, noise reduction apparatuses are increasingly required to maximize efficiency in noise-free environments.

FIG. 1 is a perspective view illustrating the structure of a general paper feeding apparatus employed in an image forming apparatus. As shown in FIG. 1, the general paper feeding apparatus used in the image forming apparatus comprises a pickup roller 15 and a pickup cam 19. A locking protrusion 13 is formed on one side of a pickup gear 11 and a clutch gear 12. A locking pawl 14 of a solenoid is locked by the locking protrusion 13. When a pickup signal is applied to the solenoid, the locking pawl 14 of the solenoid moves away from the locking protrusion 13, the clutch gear 12 is released, and the pickup gear 11 rotates. When the pickup gear 11 rotates, the pickup roller 15 picks up the uppermost sheet of printable media, such as paper, loaded in a paper cassette (not shown).

The printable medium picked up by the pickup roller 15 travels along a guide surface of a transfer guide 17, which has a predetermined curvature. An alignment roller 18 is mounted on an exterior of the transfer guide 17 to correct any paper skew occurring during the transferring process. Accordingly, the printable media are transferred to an image forming unit.

After the uppermost printable medium is picked up during one rotation of the pickup roller 15, the locking protrusion 13 of the clutch gear 12 is locked by the locking pawl 14 again, and the pickup gear 11 and the pickup roller 15 remain in a standby state until other pickup signals are received. The pickup cam 19 allows the pickup roller 15 to have a constant angle after rotating.

A paper feeding apparatus having the above structure is commonly employed and has been used for a long period of time. Currently, most printing machine manufacturers use the above paper feeding apparatus as a basic pickup and transfer device. However, the general paper feeding apparatus of the image forming apparatus has problems with noise generation.

FIG. 2 is a graph illustrating an example volume of noise as a function of time generated by the general paper feeding apparatus shown, for example, in FIG. 1. Firstly, in addition to operational noise 20*a*, noise 20*b* (generated by turning the solenoid on and off during the paper feeding) and noises 20*c* and 20*d* (generated when the pickup cam rotates and recovers) are also extremely unpleasant to the user. Secondly, while the pickup roller is in contact with the uppermost printable medium, friction occurs between the uppermost printable medium and a printable medium directly below the uppermost printable medium, generating dragging noise 20*e*. In particular, the rear portion of the uppermost printable medium is dragged along the printable medium directly below the uppermost printable medium as the uppermost printable medium passes through the transfer roller, generating friction and making noise.

Thirdly, friction noise is also generated when the printable medium travels over the guide surface of the transfer guide. In particular, the rear portion of the printable medium is rolled into a cylindrical shape by the transfer guide as the printable medium is being released from the guide surface. The rolled printable medium passes through an alignment roller and is thereby pushed into a substantially horizontal path. As a result, the printable medium rapidly unrolls, generating a shock noise 20*f*.

Some printing apparatuses, as described in, for example, Japanese Patent Laid-open No. 05-139548, use a structure wherein a printable medium is picked up with a non-contact technique using electrostatic force, instead of using a roller. Although these printing apparatuses prevent the noise 20*b* due to the solenoid, the noises 20*c* and 20*d* remain, because the pickup roller lifts up only the front portion of the uppermost printable medium. The rear portion of the uppermost printable medium is still dragged along the printable medium directly below the uppermost printable medium during the transferring process.

SUMMARY OF THE INVENTION

Several aspects and example embodiments of the present invention are to provide a paper feeding apparatus capable of preventing noises caused by friction between sheets of paper.

Additionally, another aspect of the present invention is to provide a paper feeding apparatus capable of minimizing noise caused by friction between sheets of paper and the transfer guide.

Another aspect of the present invention is to provide a paper feeding apparatus capable of reducing noise caused by shock generated between sheets of paper and the transfer guide.

Still another aspect of the present invention is to provide an image forming apparatus employing a paper feeding apparatus having the above characteristics.

Additional aspects and/or advantages of the invention will be set forth in part in the description which follows and, in part, will be obvious from the description, or may be learned by practice of the invention.

According to one aspect of the present invention, there is provided a paper feeding apparatus comprising a pickup unit, arranged at one end of a paper cassette relative, to pick up the uppermost printable medium of a plurality of printable media loaded in the paper cassette and feed the uppermost printable medium to an image forming apparatus; and a lifting unit arranged at another end of the paper cassette to lift the uppermost printable medium when the pickup unit picks up the uppermost printable medium.

According to another aspect of the present invention, the lifting unit may be disposed within the range of approximately one-half to approximately four-fifths of the length of the uppermost printable medium from the end of the uppermost printable medium.

According to another aspect of the present invention, the width of the lifting unit may cover one-fifth or more of the width of the uppermost printable medium.

According to another aspect of the present invention, the lifting unit may comprise a roller charged with a DC voltage; and a negative plate disposed on the bottom of the paper cassette to be connected to a ground; wherein an electric field is created between the roller and the negative plate.

According to another aspect of the present invention, the lifting unit may comprise a cylindrical roller in which the internal pressure is lower than the external pressure; and a plurality of suction inlets formed on the outer circumference of the cylindrical roller to lift the other end of the uppermost printable medium.

According to another aspect of the present invention, the pickup unit may comprise a charged roller.

According to another aspect of the present invention, the pickup unit may comprise a cylindrical roller, in which the internal pressure is lower than the external pressure; and a plurality of suction inlets formed on the outer circumference of the cylindrical roller to pick up the end of the uppermost printable medium.

According to another aspect of the present invention, the pickup unit may comprise a pickup roller to pick up the end of the uppermost printable medium using a frictional force by coming into physical contact with the sheet of paper.

In another aspect of the present invention, a paper feeding apparatus comprises a pickup unit, arranged at one end of a paper feeding cassette, to pick up a printable medium and to feed the printable medium to an image forming unit; and a transfer unit to transfer the printable medium picked up by the pickup unit to the image forming unit, wherein the transfer unit may comprise a transfer roller arranged to transfer the printable medium picked up from the pickup unit to be transferred to the image forming apparatus; a transfer guide spaced at a distance from an outer circumference of the transfer roller to guide the printable medium; and a plurality of idle rollers disposed in the interior of the transfer guide to come into rolling contact with the printable medium.

According to another aspect of the present invention, the transfer unit may comprise an alignment roller to align the leading portions of the printable medium.

According to another aspect of the present invention, among the plurality of idle rollers, the idle roller disposed in the final position along the direction in which the printable medium travels may be disposed within the range of approximately −15° to approximately +5° from a predetermined point on the outer circumference where a tangent line, drawn from a predetermined point if the point on the outer circumference where a tangent line, drawn from a contact portion between the alignment rollers to the outer circumference of the transfer roller, tangentially intersects the outer circumference of the transfer roller.

According to another aspect of the present invention, the plurality of idle rollers may comprise a first plurality of idle rollers and a second plurality of idle rollers; and the first plurality of idle rollers and the second plurality of idle rollers are disposed along the width of the transfer rollers. Each idle roller in the first plurality of idle rollers may partially overlap at least one idle roller in the second plurality of idle rollers.

According to another aspect of the present invention, each idle roller in the plurality of idle rollers comprises a rotation shaft; and the transfer unit may comprise a guide cover to fix the rotation shafts of the idle rollers.

According to an aspect of the invention, the paper feeding apparatus may comprise a lifting unit arranged at another end of the paper cassette to lift the printable medium when the pickup unit picks up the printable medium.

In still another aspect of the present invention, there is provided an image forming apparatus comprising an image forming unit to perform an image forming operation; a paper feeding apparatus as described above to feed the printable medium to the image forming unit for the image forming operation; and a fusing unit to fix an image to the printable medium.

In addition to the example embodiments and aspects as described above, further aspects and embodiments will be apparent by reference to the drawings and by study of the following descriptions.

BRIEF DESCRIPTION OF THE DRAWINGS

A better understanding of the present invention will become apparent from the following detailed description of example embodiments and the claims when read in connection with the accompanying drawings, all forming a part of the disclosure of this invention. While the following written and illustrated disclosure focuses on disclosing example embodiments of the invention, it should be clearly understood that the same is by way of illustration and example only and that the invention is not limited thereto. The spirit and scope of the present invention are limited only by the terms of the appended claims. The following represents brief descriptions of the drawings, wherein:

DETAILED DESCRIPTION OF THE EMBODIMENTS

Figure 1:
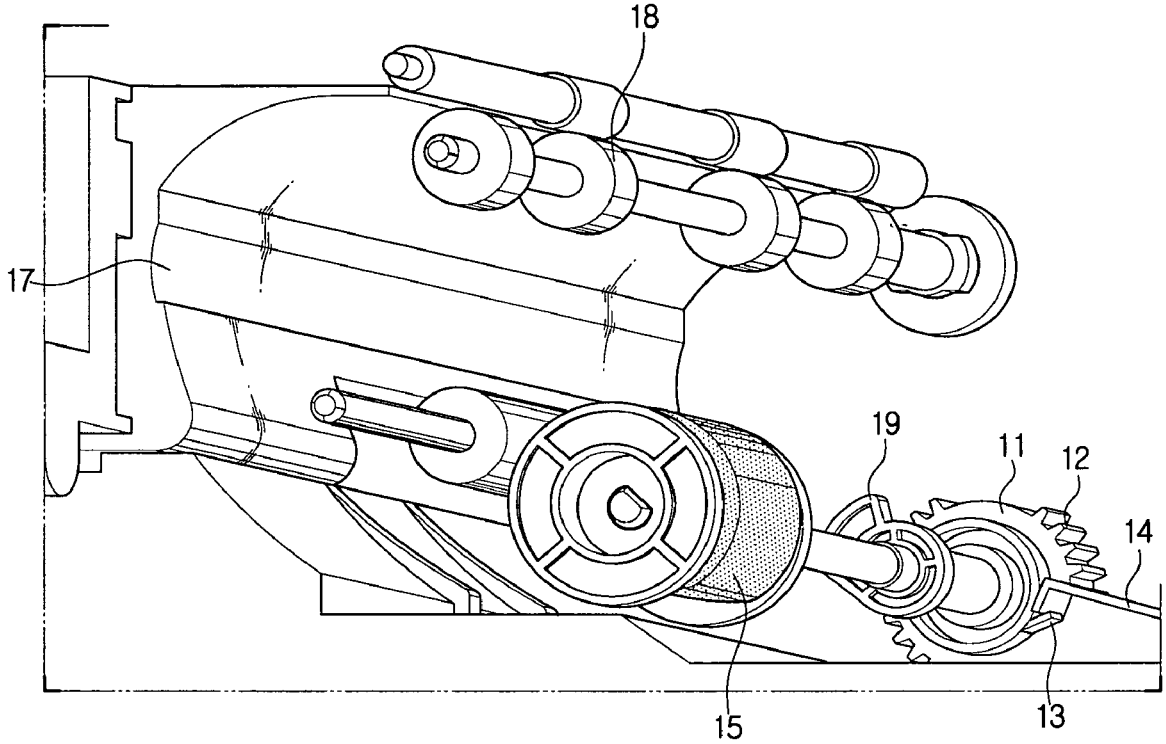
FIG. 1 (RELATED ART)
FIG. 1 is a schematic perspective view illustrating a general paper feeding apparatus of an image forming apparatus.
Figure 2:
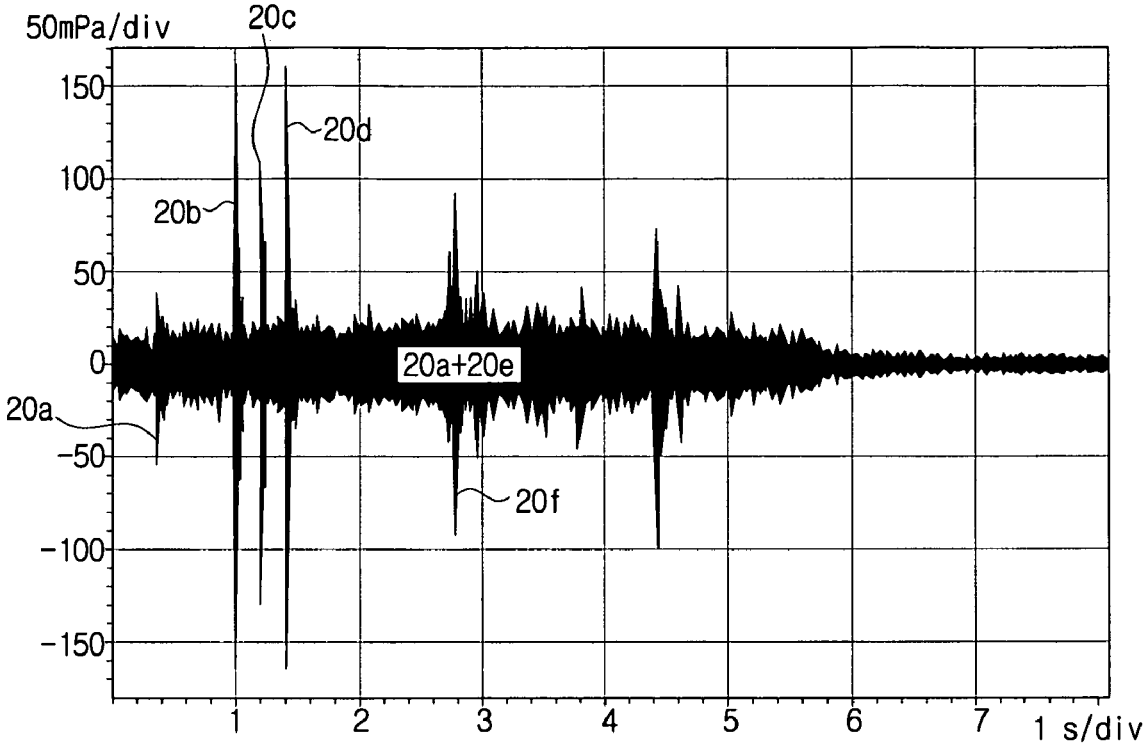
FIG. 2 (RELATED ART)
FIG. 2 is a graph recording and analyzing noise generated in the paper feeding apparatus of FIG. 1.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

Figure 3:
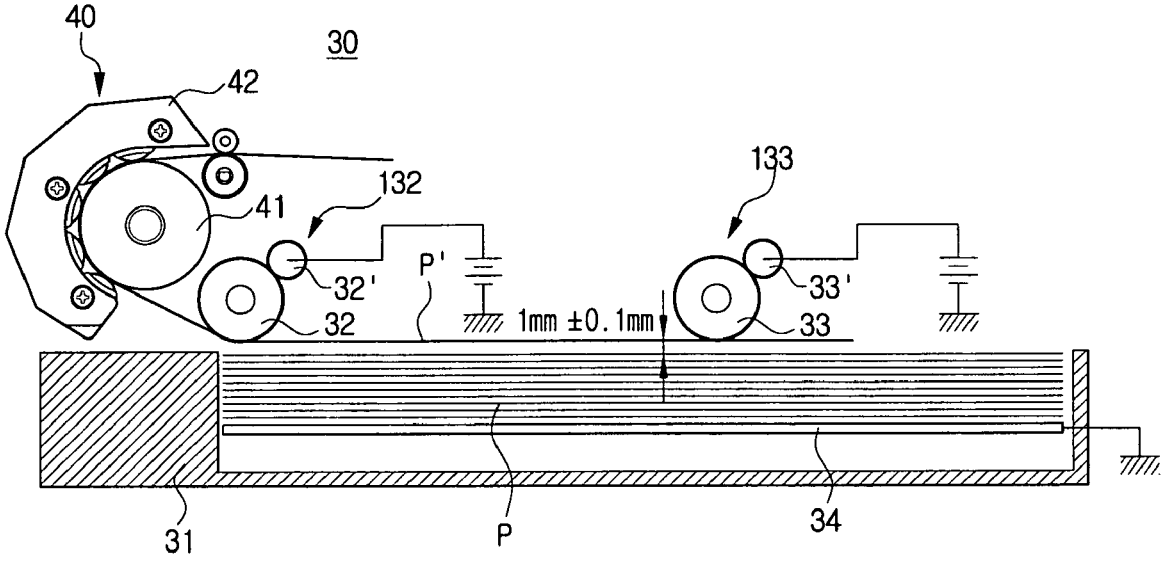
FIG. 3 is a schematic view of a paper feeding apparatus according to an example embodiment of the present invention.

FIG. 3 is a schematic view of a paper feeding apparatus 30 according to an embodiment of the present invention. In FIG. 3, the paper feeding apparatus 30 comprises a pickup unit 132 and a lifting unit 133. The pickup unit 132 is disposed upstream of a paper cassette 31 relative to the direction in which the uppermost printable medium P' loaded in the paper cassette 31 moves, to pick up the uppermost printable medium P'. The lifting unit 133 is disposed on the rear side of the upper part of the paper cassette 31 to lift the picked-up uppermost printable medium P'. Although the description refers to various components in terms of the manipulation of paper (e.g. paper feeding apparatus 30), according to other aspects of the present invention, these components may manipulate any printable medium. For example, paper feeding apparatus 30 may also feed transparent film.

The pickup unit 132 may comprise a pickup roller 32 and a first charging roller 32' to charge the pickup roller 32. The pickup roller 32 may be spaced at a distance from printable media P. The uppermost paper P' of the printable media P is picked up by the electrostatic force of the pickup roller 32 charged by the first charging roller 32'. According to another embodiment of the present invention, the pickup unit 132 may comprise a cylindrical roller, in which the internal pressure is lower than the external pressure, and a plurality of vacuum suction inlets formed on the outer circumference. A vacuum pump can be used to lower the internal pressure of the cylindrical roller. The reduced pressure creates suction, lifting the uppermost printable medium P'. The pickup unit 132 using the non-contact method described above or using the conventional pickup unit using friction can be employed in the paper feeding apparatus according to aspects of the present invention.

The lifting unit 133 may comprise a lifting roller 33 and a second charging roller 33' to charge the lifting roller 33. The lifting roller 33 is charged with a positive charge. A high voltage of approximately 1 kV is applied to the second charging roller 33'. The width of the lifting roller 33 increases so that friction between print media P can be effectively reduced. The width of the lifting roller 33 may cover one-fifth or more of the width of a sheet of paper. According to one aspect of the present invention, the lifting roller 33 may be manufactured to have a width of 60 mm based on A4 paper (width: 210 mm, length: 297 mm); however, other aspects of the present invention may use other widths, depending on the printable medium.

The lifting roller 33 may be spaced at a distance from the pickup roller 32 to lift up the uppermost printable medium P' when the pickup roller 32 picks up uppermost printable medium P'. However, to maximally reduce the drag friction between printable media P in the paper cassette 31, the lifting roller 33 may be disposed within the range of approximately one-half to approximately four-fifths of the length of the uppermost printable medium P' from the leading edge thereof.

A negative plate 34 is mounted on the bottom of the paper cassette 31 and connected to a ground. The distance between the uppermost sheet of paper in the paper cassette 31 and the lifting roller 33 is maintained at approximately 1±0.1 mm when a voltage of approximately 1 kV is used.

In the above structure, when the first and second charging rollers 32' and 33' charge the pickup rollers 32 and the lifting rollers 33, respectively, an electric field is formed between the first and second charging rollers 32' and 33' and the negative plate 34 of the paper cassette 31. As electric charge accumulates on a surface of the lifting roller 33, the electric potential increases. When the electric field strength reaches a threshold, the uppermost sheet of paper is lifted toward the lifting roller 33. As a result, when the pickup roller 32 picks up the uppermost printable medium P', it is possible to prevent drag friction between the picked-up uppermost printable medium P' and the printable medium directly beneath the uppermost printable medium P'. According to other aspects of the present invention, a plurality of lifting rollers can be mounted in order to effectively prevent friction between printable media P loaded in paper cassette 31.

In another embodiment of the present invention, a vacuum pump may be used instead of the charged lifting roller 33 to lift the uppermost printable medium P'. A plurality of inlets may be formed on the outer circumference of a cylindrical roller so that it is possible to lift the sheet of paper by maintaining the internal pressure in the cylindrical roller lower than the external pressure. The reduced pressure creates suction, lifting the uppermost printable medium P'. In this case, the technical characteristics of the above embodiment using the charged lifting roller can be applied in the same manner, except that the cylindrical roller having the inlets is used to lift up the uppermost printable medium P' instead of the charged lifting roller. Other aspects of the present invention may use other techniques to avoid friction between printable media P loaded in paper cassette 31.

Figure 4A:
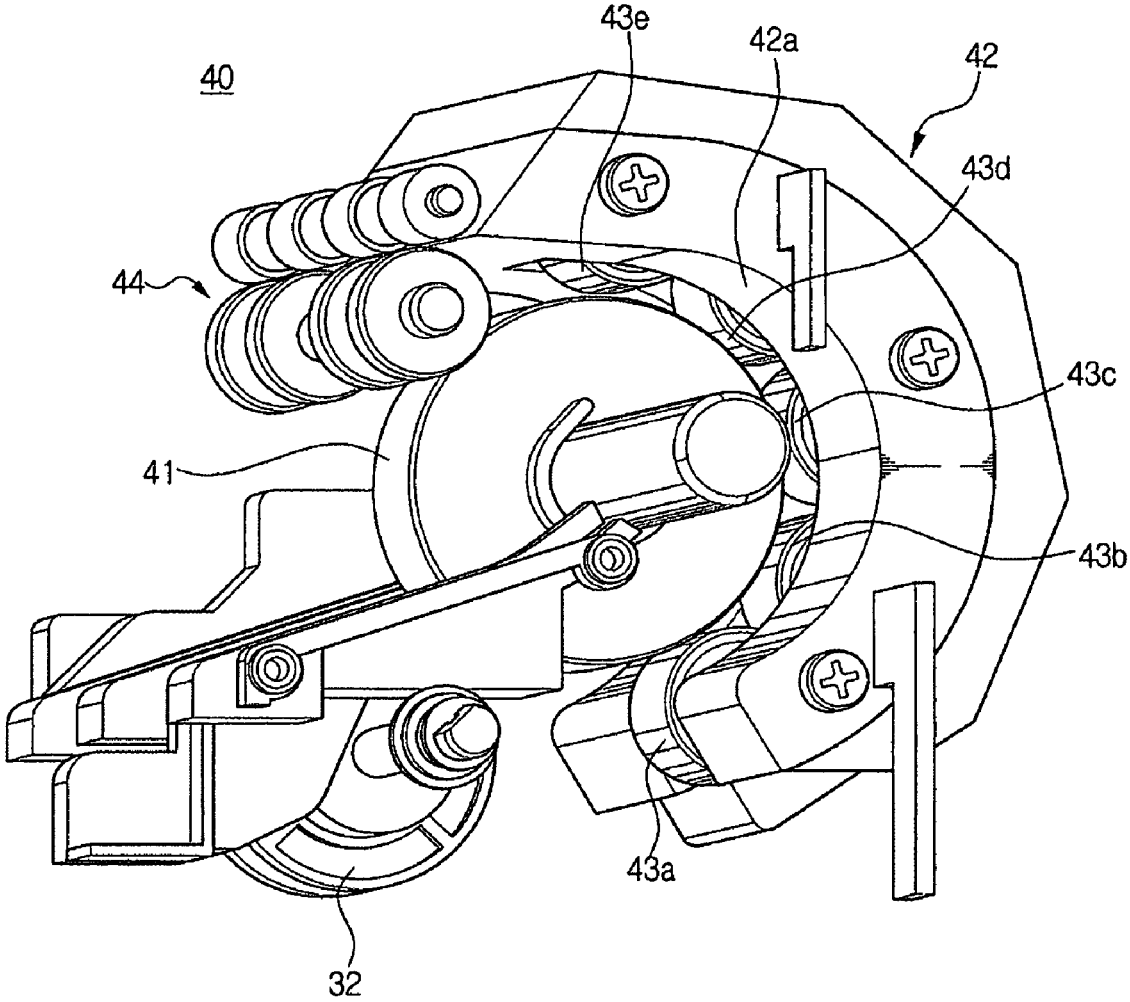
FIG. 4A is a perspective view illustrating a transfer unit of the paper feeding apparatus according to an example embodiment of the present invention.
Figure 4B:
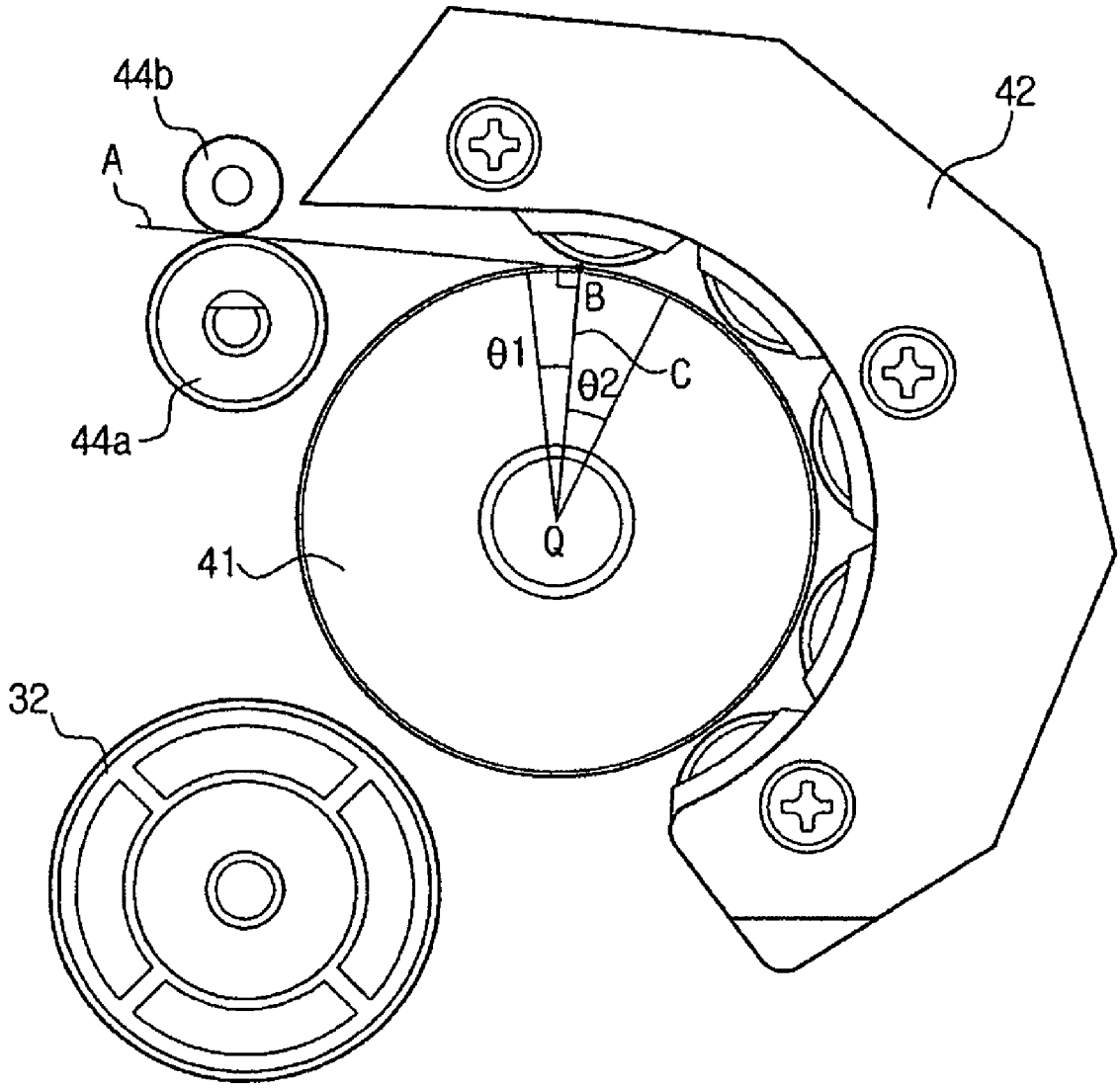
FIG. 4B is a side view of FIG. 4A.

The uppermost printable medium P' picked up as described above may be transferred to an image forming unit 50 (shown in FIG. 6) by a transfer unit 40. FIG. 4A is a perspective view illustrating the transfer unit 40 according to an embodiment of the present invention. FIG. 4B is a side view of FIG. 4A. In FIGS. 4A and 4B, the transfer unit 40 comprises a transfer roller 41, a transfer guide 42 spaced at a distance from an outer circumference of the transfer roller 41 to guide print media to be transferred, and a plurality of idle rollers 43*a* to 43*e* disposed in the interior of the transfer guide 42 to come into rolling contact with the uppermost printable medium P' (henceforth referred to as printable medium P'.) The transfer guide 42 includes a guide cover 42*a* to fix rotation shafts of the idle rollers 43*a* to 43*e*. An alignment roller 44 is positioned on an exterior of the transfer guide 42 to correct a skew of the uppermost printable medium P' occurring during the transferring process.

The transfer roller 41 has a radius covering the whole curved surface of the transfer guide 42 and significantly larger than the radius of a conventional transfer roller. The idle rollers 43*a* to 43*e* positioned in the interior of the transfer guide 42 come into rolling contact with the printable medium P' so that the printable medium P' passes through the interior of the transfer guide 42 without contacting the transfer guide 42.

The leading edge of the printable medium P' passes through the final idle roller 43*e* of the transfer guide 42 and enters the alignment roller 44. The rolled sheet of paper passing through the transfer guide 42 unrolls rapidly, generating noise. This noise may be minimized by adjusting the position of the final idle roller 43*e*. The final idle roller 43*e* may be positioned so that the paper being unrolled comes into contact with the alignment roller 44.

FIG. 4B illustrates a method for determining the position of the final idle roller 43*e*. In the case where the printable medium P' has a significantly high rigidity, a point of contact B on the outer circumference of the transfer roller 41 is determined as the point where a tangent path A, drawn from a contact point between a pair of alignment rollers 44, tangentially intersects the outer circumference of the transfer roller. The paper being unrolled enters the alignment roller 44 along this tangent path A. The final idle roller 43*e* may be positioned at the point of contact B.

However, the printable medium P' may not be made of completely rigid materials. Taking into consideration the rolling of the printable medium P', the position of the final idle roller 43*e* may be determined in the range of approximately $-15°$ ($\theta_1$) to approximately $+5°$ ($\theta_2$), from the point of contact B. With this structure, it is possible to prevent noise generated as the rear portion of the printable medium is rolled into a cylindrical shape by the transfer guide 42 while the printable medium P' is being released from the guide surface, is passed through the alignment roller 44, is thereby pushed into a substantially horizontal path, and is unrolled rapidly.

Figure 5A:
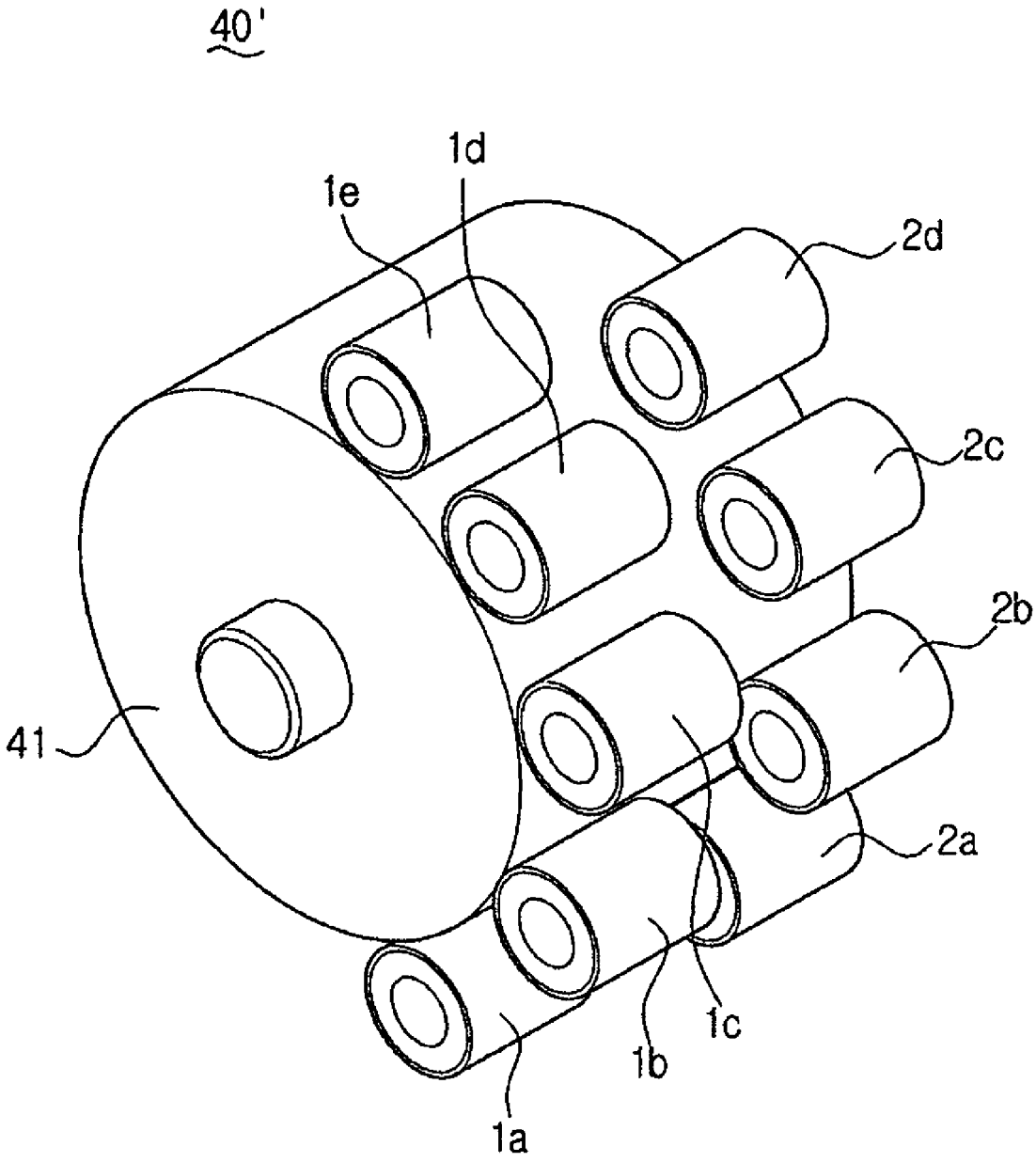
FIG. 5A is a perspective view illustrating the main part of a transfer unit of a paper feeding apparatus according to another example embodiment of the present invention.
Figure 5B:
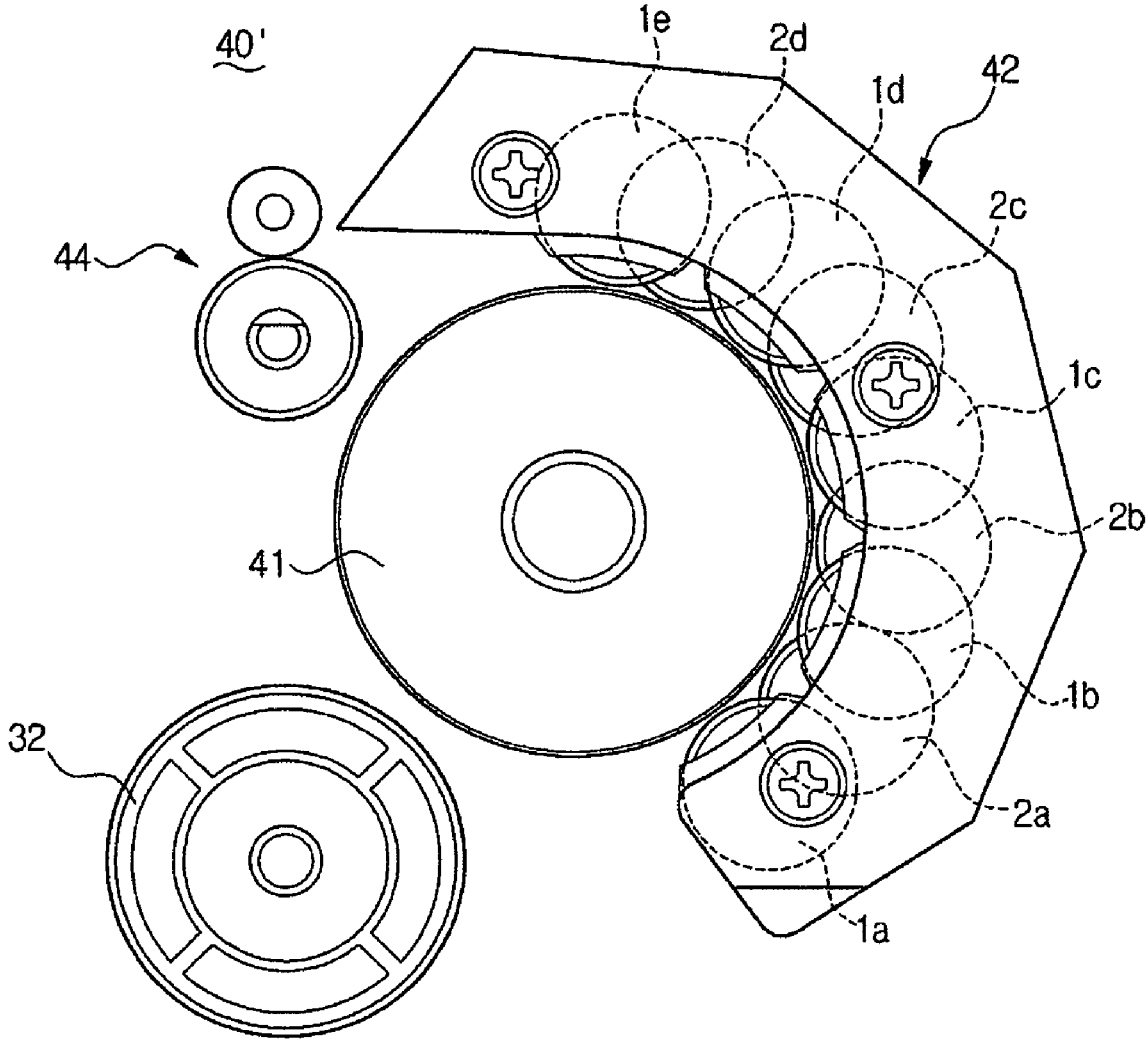
FIG. 5B is a side view of FIG. 5A.

FIG. 5A is a perspective view illustrating a transfer unit 40' according to another example embodiment of the present invention. FIG. 5B is a side view of FIG. 5A. In FIGS. 5A and 5B, the transfer unit 40' comprises a transfer roller 41, a transfer guide 42, and a plurality of idle rollers 1*a* to 1*e* and 2*a* to 2*d* disposed in an interior of the transfer guide 42.

Two stages of the idle rollers 1*a* to 1*e* and 2*a* to 2*d* are provided along the width of the transfer roller 41. The first stage rollers 1*a* to 1*e* and the second stage rollers 2*a* to 2*d* cross each other. Specifically, the outer circumferences of the rollers 1*a* to 1*e* and 2*a* to 2*d* are disposed so as to partially overlap each other, as shown in FIG. 5B. Therefore, when the leading portion of the printable medium P' with a high rigidity comes into contact with the idle rollers, it is possible to prevent jamming by holding the printable medium between the first stage rollers and the second stage rollers, not between the transfer roller 41 and the idle rollers.

Figure 6:
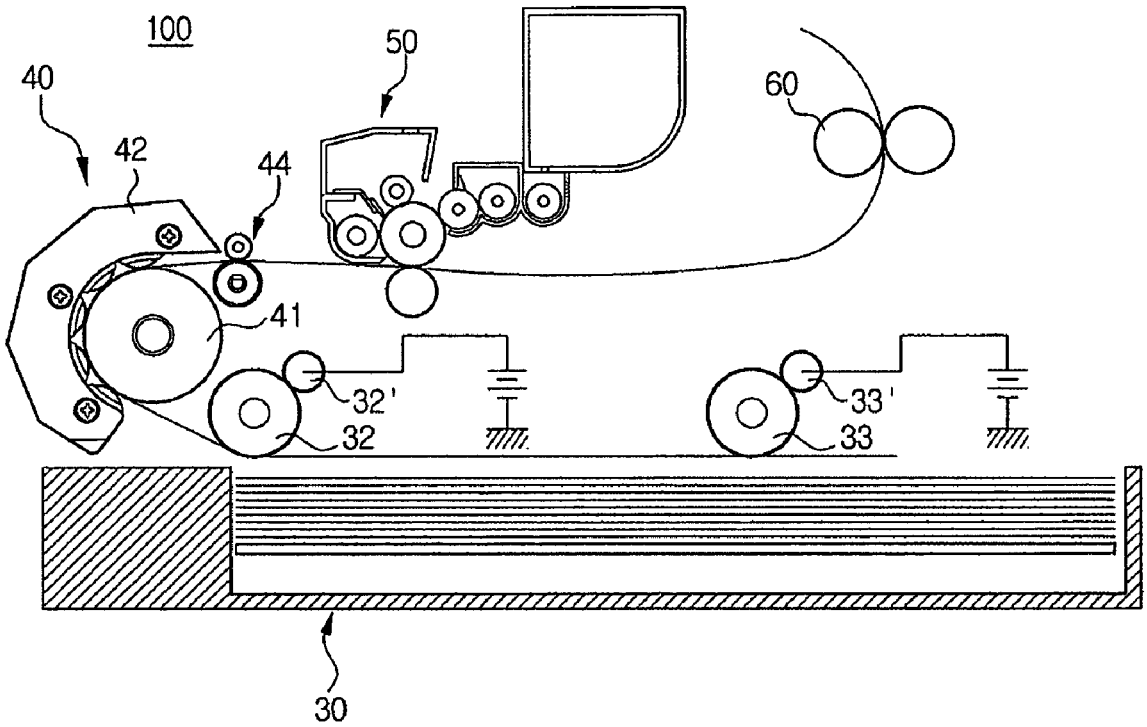
FIG. 6 is a schematic view of an image forming apparatus employing a paper feeding apparatus according to example embodiments of the present invention.

FIG. 6 is a schematic view of an image forming apparatus employing a paper feeding apparatus according to embodiments of the present invention. In FIG. 6, an image forming apparatus 100 comprises an image forming unit 50 to form a predetermined image onto a printable medium, a paper feeding apparatus 30 according to aspects of the present invention to feed paper to the image forming unit 50, and a fusing unit 60 to fuse the image to the printable medium. The detailed description about components other than the paper feeding apparatus 30 described above is omitted because the other components can be understood by known technologies.

Using structures according to aspects of the present invention, it is possible to prevent noise generated by drag between the rear portion of printable medium and another printable medium directly beneath it when feeding the printable medium, and also to reduce the noise caused by picking up the printable medium in a non-contact method using a solenoid and a pickup cam. Additionally, the printable medium is transferred while coming into contact with the idle rollers of the transfer guide, so that noise generated as a result of friction between the printable medium and the transfer guide can be prevented. Furthermore, by maintaining a printable medium as it is unrolled, it is possible to reduce noise due to paper being rapidly unrolled when a printable medium, rolled as a result of passing through the transfer guide, enters the alignment roller.

While there have been illustrated and described what are considered to be example embodiments of the present invention, it will be understood by those skilled in the art and as technology develops that various changes and modifications, may be made, and equivalents may be substituted for elements thereof without departing from the true scope of the present invention. Many modifications, permutations, additions and sub-combinations may be made to adapt the teachings of the present invention to a particular situation without departing from the scope thereof. For example, any printable medium may be used, such as paper or transparent film. In addition, any technique to pick up and feed a printable medium, without the printable medium coming into contact with a printable medium directly below the printable medium, or without generating friction between the printable medium and a printable medium directly below the printable medium may be employed. Accordingly, it is intended, therefore, that the present invention not be limited to the various example embodiments disclosed, but that the present invention includes all embodiments falling within the scope of the appended claims.

What is claimed is:

1. A feeding apparatus comprising:

a pickup unit arranged at one end of a paper cassette and spaced from the paper cassette to pick up a printable medium loaded in the paper cassette and feed the printable medium to an image forming apparatus; and a lifting unit arranged at another end of the paper cassette to lift the printable medium when the pickup unit picks up the printable medium;

wherein the pickup unit comprises a charged roller;

wherein the lifting unit is spaced from the paper cassette to define a gap between the printable medium and the pickup unit prior to the pickup of the printable medium.

2. The apparatus according to claim 1, wherein the lifting unit is disposed within the range of approximately one-half to approximately four-fifths of the length of the printable medium from the end of the printable medium.

3. The apparatus according to claim 1, wherein the lifting unit is disposed at approximately three-fifths of the length of the printable medium from the end of the printable medium.

4. The apparatus according to claim 1, wherein the width of the lifting unit covers one-fifth or more of the width of the printable medium.

5. The apparatus according to claim 1, wherein the lifting unit comprises:

a roller charged with a DC voltage; and a negative plate disposed on the bottom of the paper cassette and connected to a ground;

wherein an electric field is created between the roller and the negative plate.

6. The apparatus according to claim 1, wherein the pickup unit comprises a pickup roller to pick up the uppermost printable medium by coming into physical contact with the printable medium.

7. The apparatus according to claim 1, wherein the pickup unit is disposed at the one end of the feeding apparatus to correspond to an end of the printable medium prior to pick up, the lifting unit is disposed at the other end of the paper cassette to correspond to an opposite end of the printable medium prior to pick up, and there are no additional pickup units or lifting units between the pickup unit and the lifting unit at their respective ends.

8. An image forming apparatus comprising:

an image forming unit to perform an image forming operation;

a paper feeding unit having a pickup unit that is arranged at one end of a paper cassette and spaced from the paper cassette to pick up a printable medium loaded in the paper cassette and a lifting unit arranged at the other end of the paper cassette to pick up the printable medium; and a fusing unit to fix a predetermined image onto the printable medium;

wherein the pickup unit comprises a charged roller;

wherein the lifting unit is spaced from the paper cassette to define a gap between the printable medium and the pickup unit prior to the pickup of the printable medium.

9. The image forming apparatus according to claim 8, wherein the pickup unit picks up the printable medium by an electrostatic force.

10. The image forming apparatus of claim 8, wherein the lifting unit lifts the printable medium by an electrostatic force.

11. A method to reduce noise in a feeding apparatus having a pickup unit, arranged at one end of a paper cassette and spaced from the paper cassette to pick up a printable medium loaded in the paper cassette and feed the printable medium to an image forming apparatus; and a lifting unit arranged at another end of the paper cassette to lift the printable medium when the pickup unit picks up the printable medium, comprising:

picking up one end of a printable medium to feed the printable medium into an image forming apparatus;

lifting an other end of the printable medium; and feeding the printable medium to the image forming apparatus;

wherein the lifting unit is spaced from the paper cassette to define a gap between the printable medium and the pickup unit prior to the pickup of the printable medium.

12. The method according to claim 11, wherein the one end of the printable medium is picked up by an electric charge.

13. The method according to claim 11, wherein the other end of the printable medium is picked up by an electric charge.

* * * * *

UNITED STATES PATENT AND TRADEMARK OFFICE

CERTIFICATE OF CORRECTION

PATENT NO. : 7,828,280 B2
APPLICATION NO. : 11/698096
DATED : November 9, 2010
INVENTOR(S) : Jong-woo Kim et al.

It is certified that error appears in the above-identified patent and that said Letters Patent is hereby corrected as shown below:

Title Page Column 1 (Inventors), Line 1 delete "Younin-si (KR);" and insert -- Yongin-si (KR); --, therefor.

Column 9, Lines 8-9 in Claim 11, after "apparatus;" insert -- wherein the pickup unit comprises a charged roller; --.

Signed and Sealed this
First Day of February, 2011

David J. Kappos

David J. Kappos
*Director of the United States Patent and Trademark Office*